US006597294B1

(12) United States Patent
Ariens

(10) Patent No.: US 6,597,294 B1
(45) Date of Patent: Jul. 22, 2003

(54) MULTI-FUNCTION FLIGHT INFORMATION DISPLAY UNIT MFIDU

(76) Inventor: Jeffrey Ariens, 619 Madrid Blvd., Punta Gorda, FL (US) 33950

( * ) Notice: Subject to any disclaimer, the term of this patent is extended or adjusted under 35 U.S.C. 154(b) by 0 days.

(21) Appl. No.: 10/121,719

(22) Filed: Apr. 12, 2002

(51) Int. Cl.[7] ..... G08G 1/123

(52) U.S. Cl. ..... 340/995.26; 340/945; 340/971; 701/4; 701/14

(58) Field of Search ..... 340/945, 971, 340/972, 973, 976, 995, 995.26; 701/4, 9, 14

(56) References Cited

U.S. PATENT DOCUMENTS 3,967,098 A * 6/1976 Harnagel et al.
4,796,190 A * 1/1989 Cummings
4,994,974 A * 2/1991 Cummings
5,089,816 A * 2/1992 Holmes, Jr. ..... 340/995
5,475,594 A * 12/1995 Oder et al. ..... 340/971
6,213,266 B1 * 4/2001 Hollingsworth ..... 190/108

* cited by examiner

*Primary Examiner*—Brent A. Swarthout
(74) *Attorney, Agent, or Firm*—Frank A. Lukasik

(57) ABSTRACT

A multi-functional flight information display unit consisting of a compact, portable, and updateable display system contained within the dimensions of a traditional flight bag. The invention includes a system which gathers flight information, weather mapping, traffic, airport and other data and compiles the data, disseminates the data electronically and displays the data on a portable, compact display unit in the cockpits of large commercial aircraft, thereby eliminating paper charts and approach plates in an aircraft.

3 Claims, 5 Drawing Sheets

MULTI-FUNCTION FLIGHT INFORMATION DISPLAY UNIT MFIDU

BACKGROUND OF THE INVENTION:

The present invention relates to Electronic Flight Bags (EFB) and more particularly to an improved and expanded feature EFB called Multifunction Flight Information Display Unit (MFIDU) which becomes a compact portable and updateable electronic display system contained within the dimensions of a traditional Flight Bag. The concept of EFB's is a method of eliminating paper charts and approach plates in an aircraft. FAA Advisory Circular AC20-EFB describes a means for certification of EFB's. The present invention seeks to conform with all such Advisory Circulars or alternative FAA requirements in its certification.

Prior art products described as EFB's have elements in common with the present invention in that they offer display means for flight navigation charts and are portable and can be electronically updated by the installation of pre-prepared electronic maps. They uniformly offer small screen display approximately the size of a Jeppesen approach plate (5"×8"). Prior art systems design, features, form-factor, functionality, expandability, and software, are better suited for use in light aircraft than airline type transport aircraft.

Display size is crucial in transport aircraft. Airline pilots need a display that is at least twice the size of prior art units in order to properly view taxi diagrams of large airports as well as complex approach, arrival and departure procedures. Some prior art products feature large displays which can generally display multiple data components, a display so large however poses a problem for installation/location in existing cockpits due to lack of cockpit "real estate". Currently, manufacturers offer two basic choices: a general aviation type display that is loose or mounted, or a larger display for which most aircraft have no panel space on which to mount it.

The design of new aircraft, while rapidly advancing with changes to the state of the art, does not keep pace with new developments in electronics, digital mapping and means for displaying same. Consequently, even though larger displays are available, they require so much out-of-service time to install in existing (even brand new) aircraft that the cost cannot be justified particularly in the financially volatile airline industry. In fact, complex installations requiring panel mounting of displays, wiring, testing, STC and return to service requirements can be more costly than the hardware itself. Even 3–4 days of aircraft downtime can cost as much as $90,000–$120,000 or more in lost revenue, maintenance, engineering and outside contracting.

The present invention seeks to solve these and other problems as will be seen in the description to follow and the drawings annexed hereto.

SUMMARY OF THE INVENTION

The present invention is an EFB designed specifically for use in an airline environment with the goals of cost savings, safety enhancements, and increased efficiency with the object of creating a virtually paper-less cockpit. The invention is based upon close study and experience in the aircraft industry including avionics, flight systems, navigation and complex flight data management.

A primary object of the invention is to provide a system which gathers flight information, weather, mapping, traffic, airport and other data and compiles it, disseminates it electronically and displays it on portable compact display units in the cockpits of large commercial aircraft. A further object of the invention is display and position the plotting of:

Enroute charts.

Departure Procedures.

Engine out procedures.

STARS (Standard Terminal Arrivals)

Approach Plates.

Taxi Diagrams.

ETOPS (Extended Twin Engine Operations) & Oceanic navigational logs.

Planning Charts

10"×7" Pages. A further object of the invention is display and easy access to airline specific information:

Operations Manual

Flight Manual

MEL/CDL

Fault reporting manual

Performance Data

Checklists

Operations Specifications A further object of the invention is to collect and provide easy access to:

Enhanced Weather Information

Enhanced Turbulence Information

Ozone Concentration

Traffic Information Display

Ant-Terrorism Data

A further object of the invention is to provide a memory card to allow pilots to upload all of the flight papers, weather and dispatch release to be carried to the cockpit prior to a flight. The purpose being to eliminate the need for weather room personnel who print out vast amounts of flight papers.

A further object of the invention is to create an optional data link of information directly to the aircraft's EFB and back to ground control systems either during or after a flight.

A further object of the invention is to provide multiple EFB's as redundancy systems throughout the aircraft, for example;

One EFB for use by flight personnel to monitor food and beverage stock, sales, etc. could serve as a functional backup in the unlikely event of a failure of both cockpit systems. This concept allows the availability of an on-board spare for better dispatch reliability.

A further object of the invention is to be able to connect to the aircraft's GPS system and thus display real time map/position information.

A further object of the invention is to provide a means for displaying closed circuit video information in the cockpit for monitoring the cabin and the cockpit door. Recent terrorism has created the need for better security of the cockpit door. The MFIDU would provide a common display for display of charts as well as closed circuit monitoring of cabin activities and cockpit door entry.

A further object of the invention is to provide a single design that can fit and be utilized effectively in anything from a regional jet aircraft to a jumbo jet. Using a common design amongst aircraft requires less spare parts, permits modular exchange of components or units and reduces costs thereby.

A further object of the invention is to provide a design which will be FAA certifiable at level C1 or C2. (FAA has organized five levels of certification for EFB's C1–C5. The more tightly integrated in to the aircraft in terms of a potential hazard, the higher level of certification is required. C1 is the certification for a portable EFB, C2–C5 are for installed systems.) The present invention offers maximum features and functionality while maintaining the more cost effective design and installation requirements of a C1 & C2.

A further object of the invention is to provide purchasers tools to enter their own tailored data. Tailored data represents a high cost item since it is unique to each airline, but, by offering common worldwide core data in the unit to all airlines, they will be able to tailor their own pages in house thus offering great financial and convenience advantages.

A further object of the invention is to provide an EFB which will replace a pilot's traditional flight bag. The EFB of the invention has approximately the same dimensions as a regular flight bag, constructed of lightweight metal and containing a central electronic control unit (computer), a small keyboard and a full-size sunlight readable LCD display, the EFB makes use of the space available on all transport aircraft that is traditionally used by pilots to stow their flight bags. The display is deployed from the MFIDU on the end of a telescopic and swiveling arm and can be angled to provide optimum viewing. When not in use, or in the case of emergency egress, the display can be pushed back down into the MFIDU and out of the way. Neither the display, the articulating arm, or the stowage case will impede the crew of an aircraft in the performance of normal tasks associated with the operation of the aircraft. The articulating arm will lock easily into position with a range of position options to suit individual pilots and aircraft. Locking mechanisms are low-wear to prevent slippage after extended use.

It is a further object of the invention to replace existing high quality U.S. Govt. NOS and Jeppesen paper charts and plates with electronic equivalents which are accessed through the invention MFIDU. Current paper charts and plates although useful and popular with pilots, are very expensive to keep updated and tailored to specific airline needs. The electronic version of these charts would be designed to take advantage of the capabilities of electronic display and provide a more easily readable version of what today is printed on paper. By providing a single world-wide common database and offering the opportunity to tailor their own plates, the present invention is extremely cost effective in comparison to previous systems built on custom paper for each user.

DETAILED DESCRIPTION OF A PREFERRED EMBODIMENT

Figure 1:
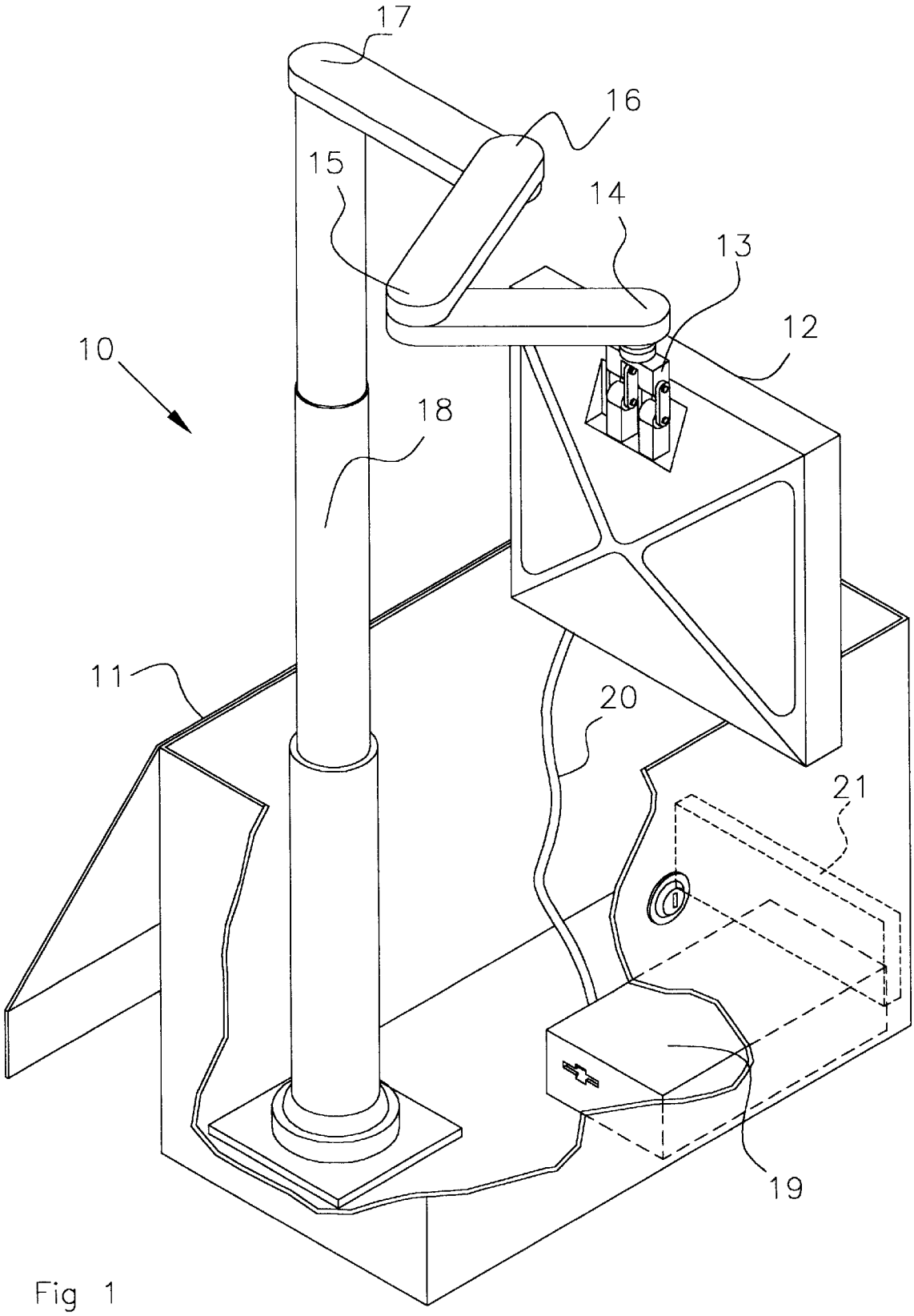
FIG. 1 is an isometric view, partially in section of the invention.
Figure 2:
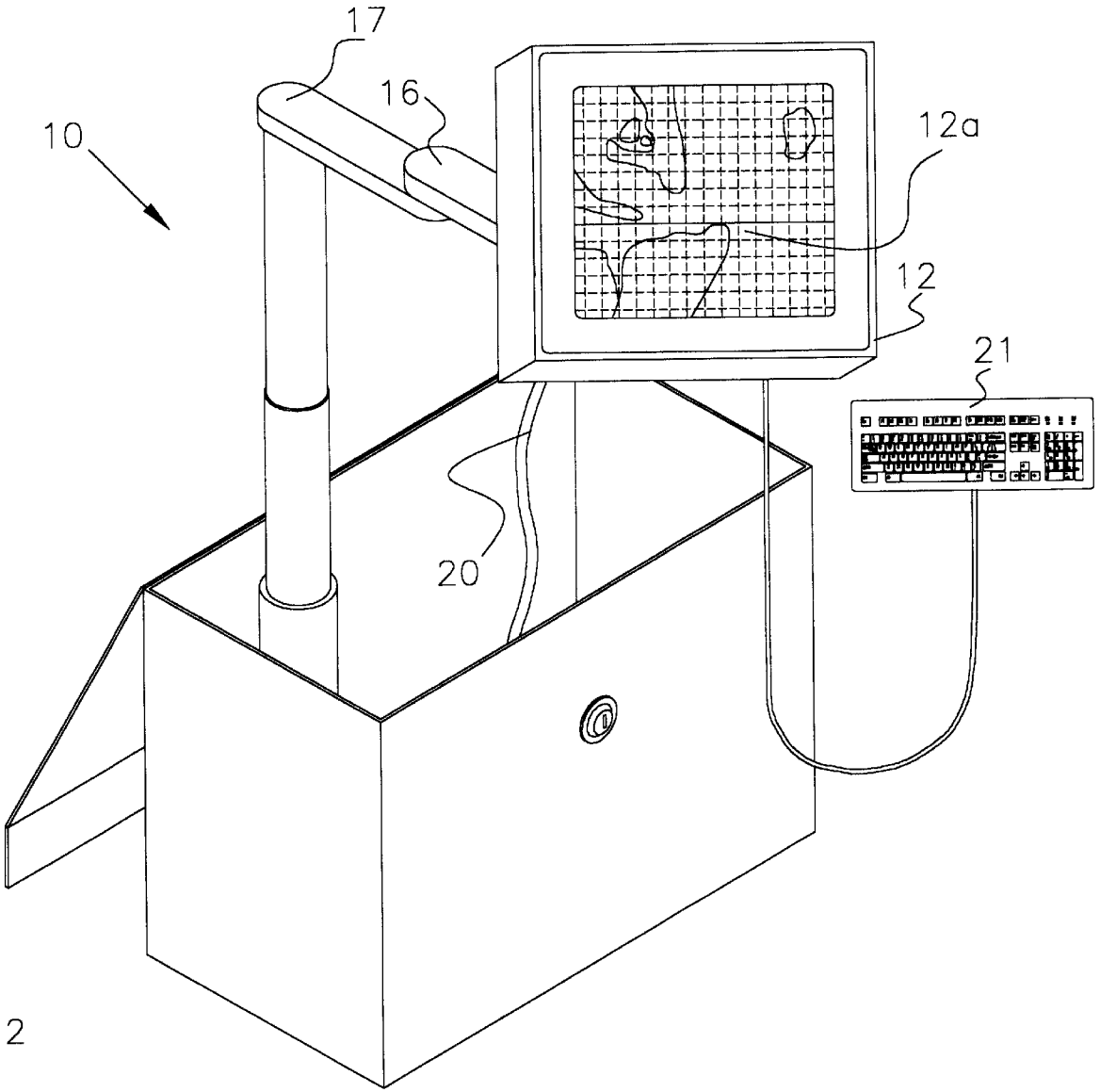
FIG. 2 is an isometric view showing the invention fully deployed

Referring now to the drawings wherein like numerals designate like and corresponding parts throughout the several views, in FIG. 1 and FIG. 2 the invention is designated overall by the numeral 10. In FIG. 1, metal case 11 is mounted with telescoping cylinder 18 swivel joints 15, 16 and 17 rotate around cylinder 18. LCD display 12 is adjustably connected at swivel joint 14 by connector 13. Computing device 19 connects through cable 20 to LCD 12. Input device/keyboard 21 is stowed inside case 11. Referring now to FIG. 2. LCD screen 12 and keyboard 21 are now fully deployed having been raised by cylinder 18 and swung in place by swivels 15, 16 and 17. Connector 13 holds LCD screen 12 in an upright position. Data maps 12*a* are available for viewing.

Figure 3:
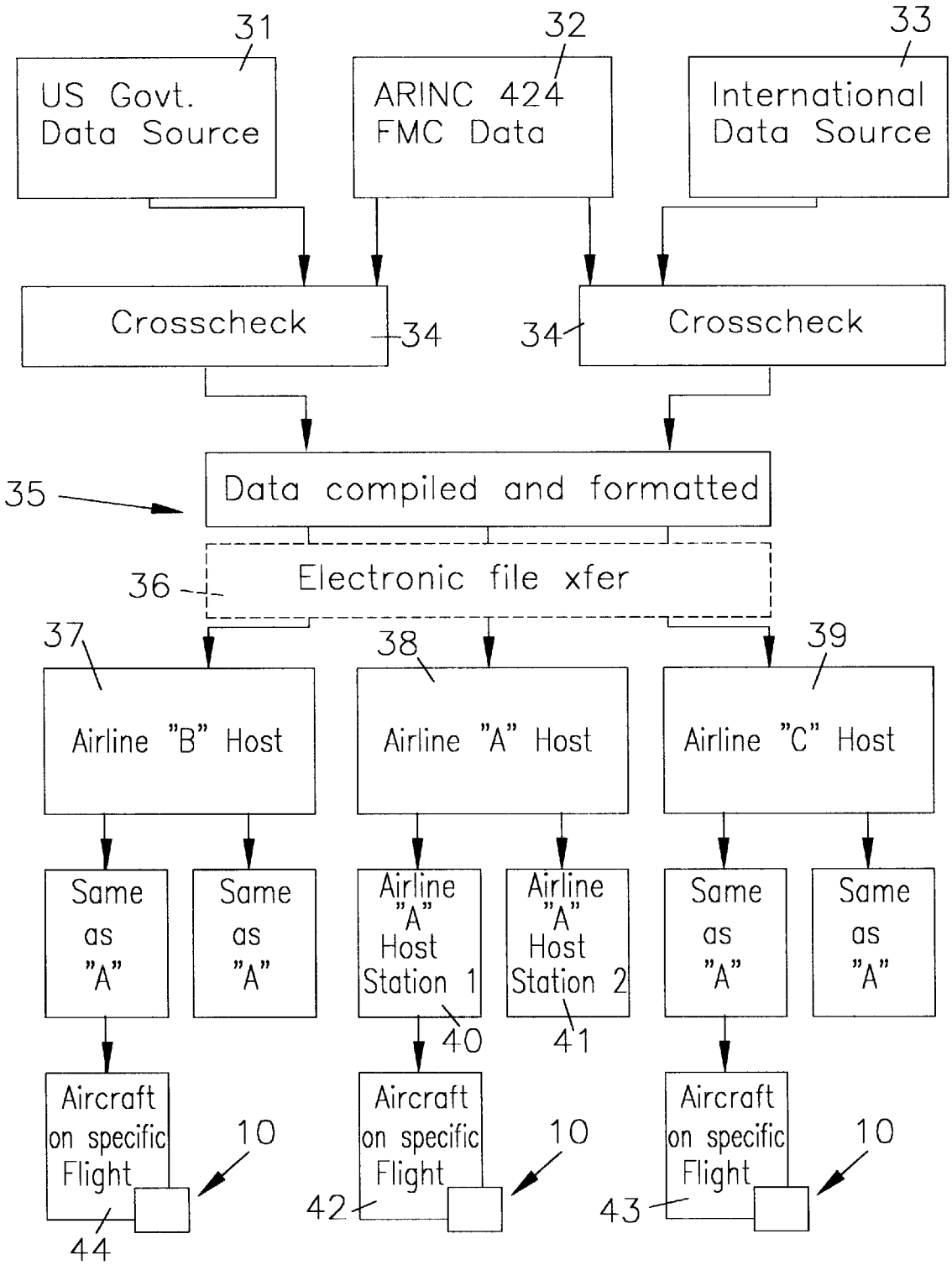
FIG. 3 is a diagrammatic flow chart showing the data flows through the invention.

Referring now to FIG. 3. Raw Data from Govt. source, 31, ARINC 424 FMC Data 32 and ICAO data 33 are collected. Data is cross-checked for accuracy 34 and compiled and formatted according to the instant invention process 35. Formatted and compiled data updates are electronically transferred 36 to Airline hosts 37, 38 and 39. Airline host stations 40 and 41 transfer data to aircraft 42, 43 and 44 for specific flights. Data is loaded into MFIDU 10 for use during and after flight.

Figure 4:
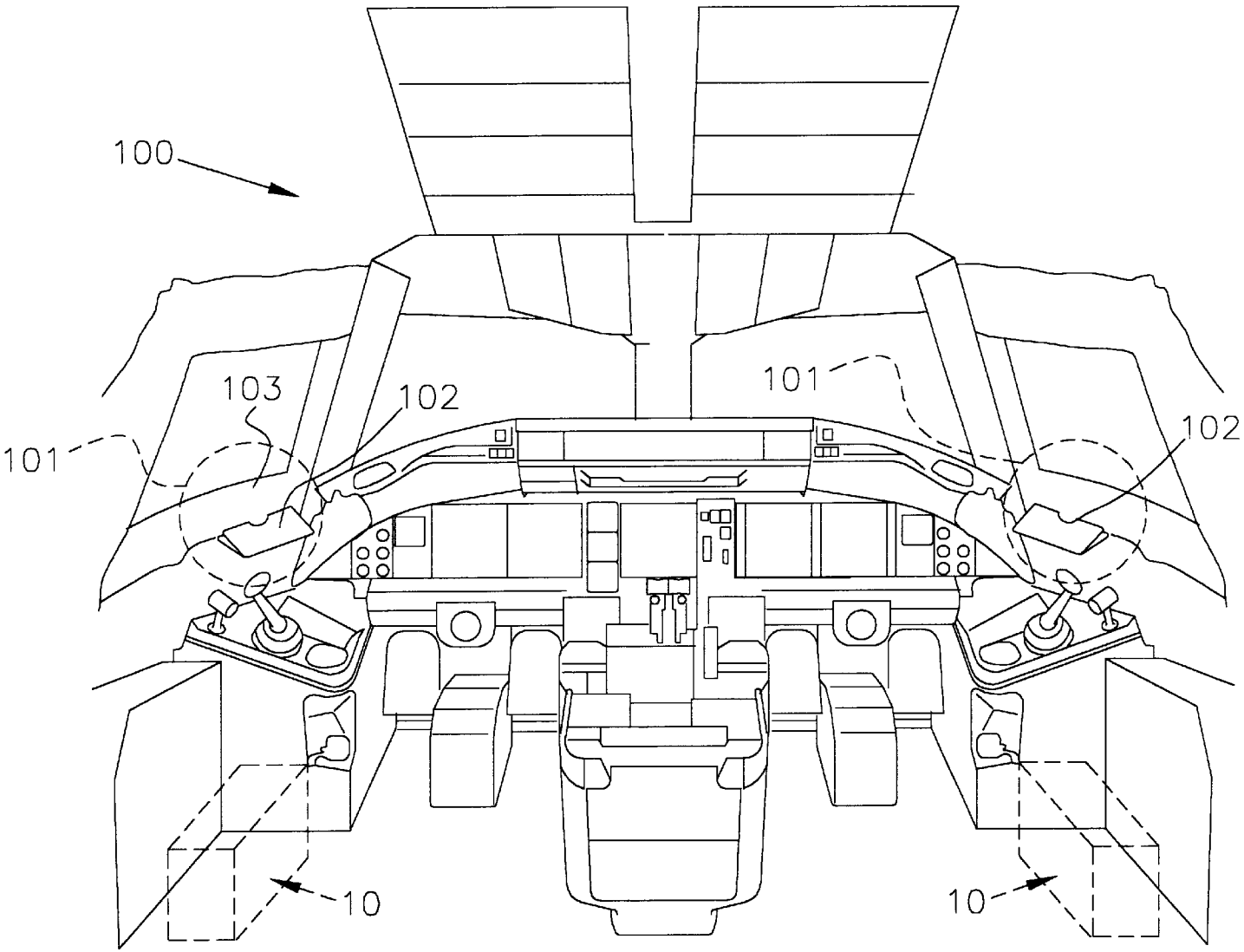
FIG. 4 is an elevational view of a typical Boeing 757/767 cockpit.
Figure 5:
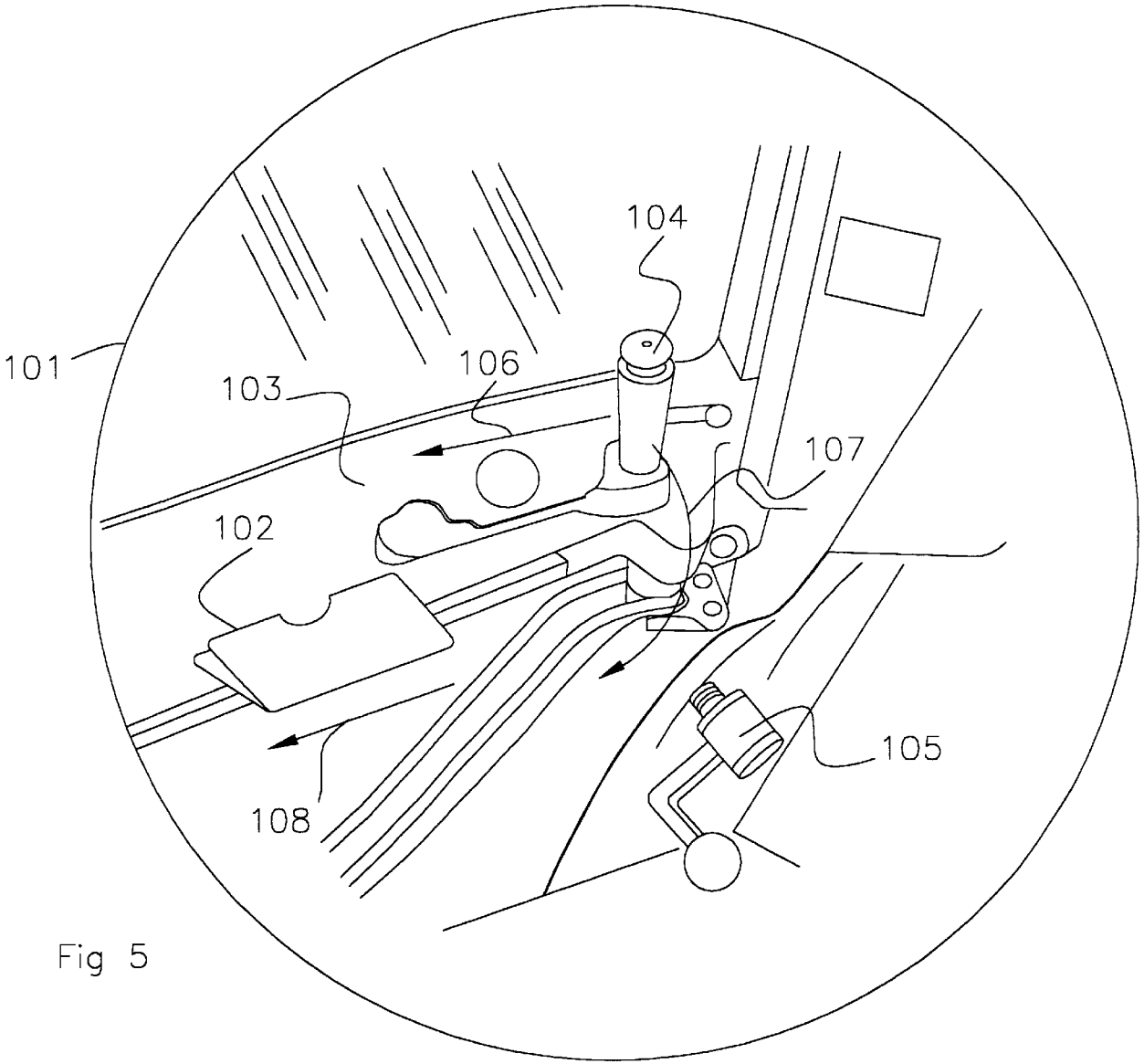
FIG. 5 is an enlargement detail of the window locking mechanism in a 757/767 cockpit.

A second embodiment of the invention is illustrated in FIGS. 4 and 5 to which reference is now made. In FIG. 5, an aircraft cockpit (Boeing 757/767) is designated overall by the numeral 100. The MFIDU 10 is located on the floor of the cockpit in the place typically used for a pilot's flight bag, deployment of the MFIDU in this location is described in FIGS. 1 and 2. An alternative deployment location for LCD screen 12 is shown in broken line circle 101. In this location, it is common for a clipboard 102 to be installed because it is within easy visual access by the pilots. Replacing clipboard 102 by LCD screen 12 would enable pilots to readily access data being displayed. Clipboard 102 is removably attached on window sill 103 for safety reasons, namely that the window locking / opening levers and crank are also attached in the same location as seen in FIG. 5 to which reference is now made.

To release the cockpit side window, lock lever 104 is pulled out in the direction of arrow 107 and back in the direction of arrow 106. This allows the window to be cranked open by crank 105. Moving lock lever 104 requires the movement of clipboard 102 in the direction of arrow 108, this is facilitated by an attachment system built into the aircraft at the time of manufacture. LCD screen 12 can be simply adapted to use the same attachment system becoming thereby readily movable in emergencies.

What is claimed is:

1. A programmable electronic flight bag and electronic map display system for collecting, transmitting, and interfacing essential flight data within transport aircraft cockpits, said system comprising:

a rectangular shape metal case, a support means being removably attached within said metal case, said support means having a telescoping cylinder and a plurality of swivel joints, said support means having a proximal end and a distal end, a display screen being adjustably attached to said distal end of said support means, said display screen being programmable for displaying enroute charts, aircraft departure procedures, engine out procedures, S.T.A.R.S., approach plates, taxi diagrams, ETOPS, ocean navigation logs and planning charts, computing means being removably contained in said metal case, said computing means being operatively connected to said display screen, said computing means having a plurality of input means including a floppy disk mechanism, a CD reader, a flashcard port, a parallel port, an ethernet port and a DIN port, data collection means for gathering raw data including U.S. Government flight data,. ARINC 924 FMC data, International flight data, weather data mapping, air traffic, airport gate and taxiway data, said collection means having a compilation and sorting means, said sorting and compiling means having a plurality of transmitting means, said transmitting means being compatible with said computer means, said computer means being compatible with aircraft Global Positioning System data systems, said displaying means displaying said Global Positioning System data, a closed circuit video camera, said camera interfacing with said computing means for displaying video camera images, a memory flash card being compatible with said computing means and an airport weather room computer, and a radio interface connected to said computing means for forming an uplink and a downlink between an aircraft and ground based control stations, said radio interface transmitting real time flight data including aircraft operational data, security data and video data.

2. A programmable electronic flight bag and electronic map display system of claim 1, wherein said computing means being programmed for electronically storing an aircraft operations manual, a fault reporting manual, performance data, checklists, operations specifications, weather information, turbulence information, ozone concentration information, traffic information, security and anti-terrorism data.

3. A programmable electronic flight bag and electronic map display system of claim 1 wherein said display screen is removably attached to the window sill of an aircraft at the location of a clipboard and replacing said clipboard.

* * * * *